United States Patent [19]

Ojalvo

[11] 4,129,974

[45] Dec. 19, 1978

[54] WARP-RESTRAINING DEVICE AND IMPROVEMENT TO BEAMS, GIRDERS, ARCH RIBS, COLUMNS AND STRUTS

[76] Inventor: Morris Ojalvo, 2258 Wickliffe Rd., Columbus, Ohio 43221

[21] Appl. No.: 480,513

[22] Filed: Jun. 18, 1974

[51] Int. Cl.[2] ..... E04C 3/06

[52] U.S. Cl. ..... 52/729; 29/155 R

[58] Field of Search ..... 52/729, 711, 641, 644; 29/155 R, 155 C

[56] References Cited

U.S. PATENT DOCUMENTS

| | | | |
|---|---|---|---|
| 542,283 | 7/1895 | Rousseau | 52/729 |
| 1,320,072 | 10/1919 | Long | 52/729 |
| 1,360,720 | 11/1920 | Brown et al. | 52/729 |
| 1,725,439 | 8/1929 | Carns | 52/729 |
| 1,906,683 | 5/1933 | Weiskopf et al. | 52/729 |
| 2,056,563 | 10/1936 | Budd et al. | 52/729 |
| 2,065,493 | 12/1936 | Greulich | 52/729 |
| 2,078,117 | 4/1937 | Auryansen | 52/729 |
| 3,101,272 | 8/1963 | Setzer | 52/729 |
| 3,126,709 | 3/1964 | Dougherty | 52/729 |
| 3,300,839 | 1/1967 | Lichti | 52/729 |

FOREIGN PATENT DOCUMENTS

| | | | |
|---|---|---|---|
| 552206 | 11/1956 | Belgium | 52/729 |
| 1357512 | 1964 | France | 52/729 |

OTHER PUBLICATIONS

Manual of Cold Formed Welded Structural Steel Tubing, published by Welded Steel Tube Institute, Inc., p. 223, Disclosed by U.S. Steel Engr. & Consulting, Inc. Jul. 6, 1973.

*Primary Examiner*—Price C. Faw, Jr.

[57] ABSTRACT

The invention relates to a novel method of improving the torsional rigidity and the torsional strength of straight or curved beams and girders, columns, struts, arch ribs and other elongate structural members whose cross section includes two or more parallel or approximately parallel flanges. The invention achieves the improvement through the attachment of an additional troughlike element so that a tube-type form connecting the flanges is created.

3 Claims, 8 Drawing Figures

INVENTOR
Morris Ojalvo

WARP-RESTRAINING DEVICE AND IMPROVEMENT TO BEAMS, GIRDERS, ARCH RIBS, COLUMNS AND STRUTS

It is well known that structural members with cross sectional profiles which are both open and thin-walled have low torsional rigidity and develop high stresses when they are acted upon by loads which cause torsional moments about their longitudinal axes. A rolled steel channel, I —, H — or wide flange beam is but one example of a thin-walled open profile cross section member of the type which may be improved by my invention. It is said to be thin-walled because the web and flange thicknesses are small in comparison to the other cross sectional dimensions and its profile is said to be open because there is not longitudinal tubular portion to the member.

It is also known that the torsional properties of these members can be improved by suppressing their tendency to warp under the influence of torsional moments. Warping distortions may be understood by reference to a member having an H profile cross section. If a section perpendicular to the member's length is considered, it is apparent that all four flange tips lie in a single plane which is the plane of the cross section. With the application of torsional forces to the member, displacements in the longitudinal direction occur generally and the four flange tips previously considered no longer lie in a single plane. This type of differential longitudinal movement is referred to as a warping of the cross section. FIG. 3 represents a member of the foregoing type. It is prevented from rotating about its longitudinal axis at its ends while longitudinal twisting forces are distributed to it between the ends. Warping distortions are evident at the ends where the flange tips are seen to no longer lie in a single plane. FIG. 4 represents a similar member except that warping has been restrained at the end cross sections. If the warping can be suppressed partially or completely at one or several sections along the length of the member, the torsional behavior of the entire member is improved. Previous suggestions for restraining warping have not included the method of suppressing warping which is the subject of this invention. Inge Lyse and Bruce G. Johnston have suggested a procedure referred to as "boxing" for the suppression of warping in a paper published in Volume 101 of the transactions of the American Society of Civil Engineers (Pages 857 to 896). But it is clear from their figures, from the manner they effected warping restraint in their test specimens and from their recommendations for effecting warping restraint in practical applications that by the term "box" they did not visualize the construction of a tubular form between the flanges of the beams.

The improvement of a member's torsional properties is useful because torsional stresses and deformations are reduced when the loads cause torsional moments. The loads cannot always be made to pass through the shear center of spandrel beams and consequently torsional forces are unavoidable. Curved beams will almost always be subject to torsional forces so that any improvement of the torsional properties will result in reduced rotational deformations, torsional stresses and reduced deflections. Torsionally weak beams, columns, struts and arches may fail prematurely by flexural buckling (lateral-torsional buckling) and torsional buckling. It is therefore obvious that the improvement of the torsional properties through the use of one or more wrap-restraining devices of the sort which is the subject of this invention can also prevent a premature failure of these members by buckling. As a practical matter it means that higher flexural and compressive stresses may be used in the design of beams and columns when warping is restrained.

The invention relates to a method of improving the torsional rigidity and strength of straight or curved beams and girders, columns, struts, arch ribs and other like structural members whose cross section included two or more parallel or approximately parallel flanges. The invention achieves the improvement in the torsional rigidity and torsional strength by the attachment to the member of additional material consisting of a single preformed element. The additional material when fitted between the flanges and fastened to the member creates, either by itself or in conjunction with a part of the member to which it is attached, a tubular form extending between the flanges and connected to the flanges at its extremities. The flanges of the reinforced member should preferably completely seal the ends of the tubular form thus created. The attachment of the additional element along the lines, areas and points of contact between it and the member it reinforces is preferably continuous. The attachment process may employ the technique of fillet or groove or spot welding, or brazing. Adhesives and closely spaced fasteners such as bolts, rivets and screws may also be used to attach the additional element to the member.

The various objects and features of my invention will be fully understood from the following detailed description of a typical preferred form and application of my invention. Throughout reference is made to the accompanying drawings in which:

FIGS. 1*a* to 1*e* are perspective drawings of elements typical of those constituting the additional troughlike element which is fitted between the flanges of the member to be reinforced and connected to it.

FIGS. 1*a*–1*e* show several examples of the elements 3 which may be fitted between the flanges of beams, arch ribs, columns and struts. The end edges 1 of the elements 3 fit against the inside of the flanges while the longitudinal edges 2 fit against the web of the member which is to be reinforced. The elements may be fashioned from plate material or they may consist of lengths of channels or angles formed by any suitable process. The elements 3 through they may be v-shaped or channel-shaped or c-shaped or cylindrically-shaped in cross section all have the characteristics of an open ended trough. To aid in the fitting of an element to a member it may be desirable to chamfer or grind off or otherwise remove a small amount of material at the junctures of edges 1 and 2. An element may also consist of a tubular segment (not shown) which can be fitted between the flanges of the member and fastened to the flanges at each end.

Figure 1A:
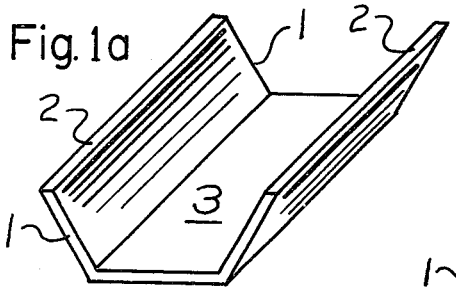
Figure 1B:
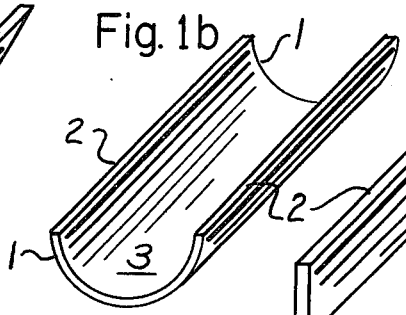
Figure 1C:
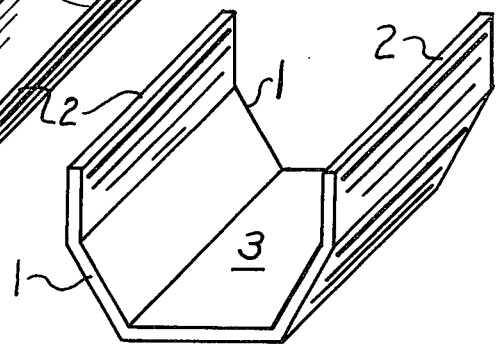
Figure 1D:
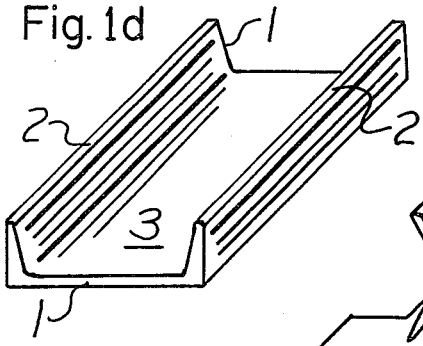
Figure 1E:
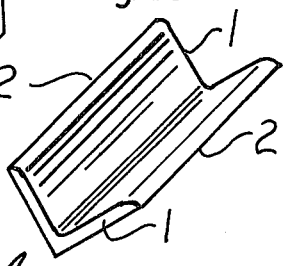
Figure 2:
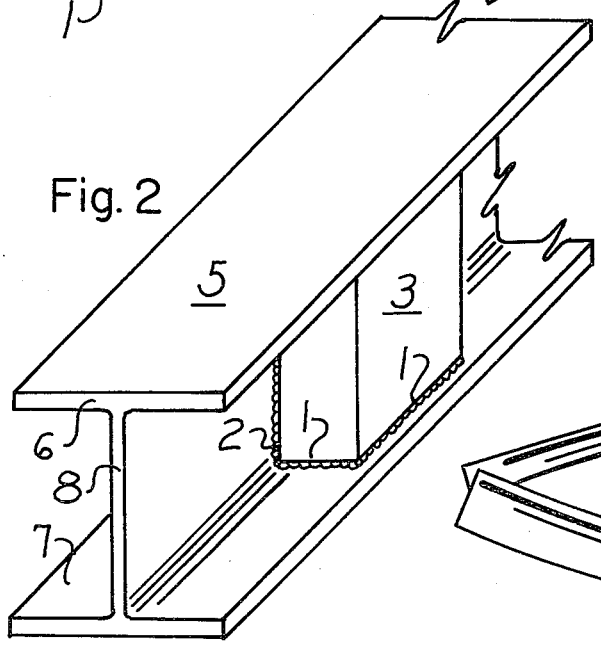
FIG. 2 is a perspective view of an H -, I - or wide-flanged beam with an element fastened to it so as to produce the tubular form which is the subject of my invention.

FIG. 2 shows a reinforcing element 3 of the type depicted in FIG. 1 attached to an H-shaped member 5.

Member 5 is typical of members which can be benefited by the warp-restraining device of this invention. The element 3 forms three sides of a tubular form extending between the flanges 6 and 7. The web 8 of member 5 included between edges 2 of element 3 supplies a fourth and closing side of the tubular form. If beam 5 and element 3 were steel, fillet welding would be the preferred method of attachment along the edges designated 1 and 2. Warp-restraining devices 3 may be used in pairs and placed symmetrically on each side of the web for greater effectiveness when the flanges extend on both sides of the web.

The thickness, the locations, shape and mode of fastening of the added elements may readily be determined by the engineer or technician responsible for the overall design of the member. The precise benefit obtainable from the addition of any particular tubular element by the methods prescribed herein is determinable from the theory of structural mechanics.

Figure 3:
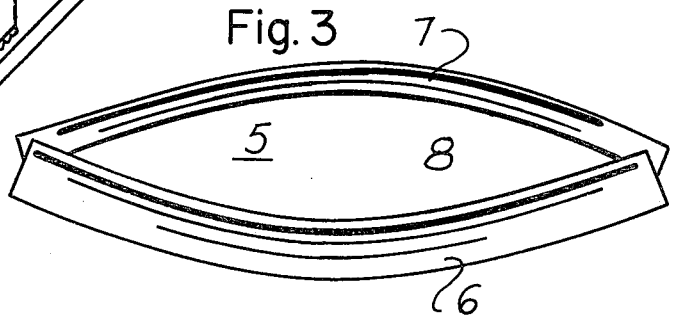
FIG. 3 is a plan view showing how the upper and lower flanges of a beam would deform under torsional forces applied along the length it the ends were prevented from twisting but were not restrained against warping.
Figure 4:
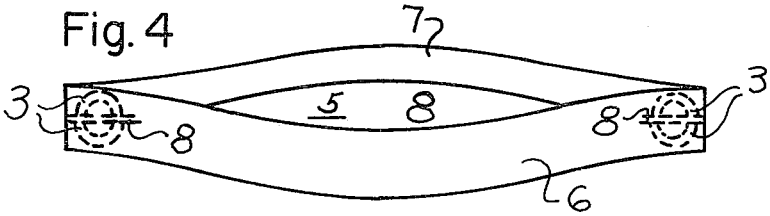
FIG. 4 is a plan view of the beam described as for FIG. 3 but with the ends restrained from warping.

FIGS. 3 and 4 when viewed together clearly illustrate how the torsional performance of the flanged member 5 is improved when warping is suppressed at the ends with elements 3 of this invention. FIG. 3 represents a plan view of the flanges 6 and 7 of the beam 5 with a twisting couple applied near the center of its length. The top flange 6 is seen to deflect in one direction while the bottom flange 7 deflects in the opposite direction. At the ends the flanges are seen to have a rotation about an axis normal to their planes. The flanges rotate in opposite directions and produce the warping distortion previously referred to. Each flange works as a simply supported beam and as such supplies a part of the resistance to rotation. FIG. 4 shows the way in which the same flanges behave when warp-restraining devices 3 of this invention are used at each end. The flanges behave much as fixed-ended beams and as such supply a much higher resistance to torsional deformations of the beam. FIGS. 3 and 4 make evident that elements 3 when attached as described herein increase the torsional rigidity of member 5. It can be shown from the theory of structural mechanics that the restraint to warping also reduces the maximum intensities of extensional and shearing stresses.

Having described my invention, I claim:

1. A method of inhibiting warping deformations of the character described and improving thereby the torsional rigidity and torsional strength of elongate structural members having a shape in cross section which is substantially that of an H an I or a channel consisting of two flanges and one rectangular web by fastening to these members at one or more locations a preformed element having the shape of a trough with open ends, said troughlike element being fitted between opposing flanges with both longitudinal edges in contact with and attached to the web in a continuous or substantially continuous manner and with the end edges in contact with and attached to the inner faces of the flanges in a continuous or substantially continuous manner thereby forming with a portion of the web and a portion of each flange of the elongate structural member a tubular form with sealed ends extending between the flanges.

2. An improved structural member comprising:

At least two substantially parallel flanges;

At least one rectangular web interconnecting said flanges;

At least one element having the shape of a trough with open ends positioned between an opposing pair of said flanges with the end edges of said element connected in a continuous or substantially continuous manner to the inner faces of said flanges and with said longitudinal edges of said element in contact with and connected to the web in a continuous or substantially continuous manner.

3. An improved elongate structural member comprising:

At least two substantially parallel flanges;

At least one web interconnecting said flanges;

At least one tubular element positioned between an opposing pair of said flanges with the end edges of said element connected in a continuous or substantially continuous manner to said flanges.

* * * * *